United States Patent [19]

Dickakian

[11] Patent Number: 4,522,701

[45] Date of Patent: Jun. 11, 1985

[54] PROCESS FOR PREPARING AN ANISOTROPIC AROMATIC PITCH

[75] Inventor: Ghazi B. Dickakian, Greenville, S.C.

[73] Assignee: E. I. Du Pont de Nemours and Company, Wilmington, Del.

[21] Appl. No.: 348,029

[22] Filed: Feb. 11, 1982

[51] Int. Cl.[3] ..... C10C 3/00

[52] U.S. Cl. ..... 208/40; 208/22; 208/45

[58] Field of Search ..... 208/40, 45, 22

[56] References Cited

U.S. PATENT DOCUMENTS

| | | | |
|---|---|---|---|
| 2,992,181 | 7/1961 | Renner | 208/22 |
| 3,373,101 | 3/1968 | Folkins et al. | 208/40 |
| 3,692,663 | 9/1972 | Kyoto | 208/44 |
| 3,721,658 | 3/1973 | Dickakian | 260/82 |
| 3,725,240 | 5/1971 | Baum | 208/76 |
| 3,835,024 | 9/1974 | Kyoto et al. | 208/44 |
| 3,919,376 | 11/1975 | Schulz | 264/102 |
| 3,970,542 | 7/1976 | Bongertman | 208/22 |
| 4,086,156 | 4/1978 | Dickakian | 204/294 |
| 4,184,942 | 1/1980 | Angier et al. | 208/22 |
| 4,208,267 | 6/1980 | Diefendorf et al. | 208/22 |
| 4,219,404 | 8/1980 | Dickakian | 208/39 |
| 4,271,006 | 6/1981 | Dickakian | 208/40 |
| 4,363,715 | 12/1982 | Dickakian | 208/45 |

FOREIGN PATENT DOCUMENTS

| | | | |
|---|---|---|---|
| 765916 | 9/1971 | Belgium | 208/44 |
| 2555812 | 6/1976 | Fed. Rep. of Germany | 208/44 |

*Primary Examiner*—D. E. Gantz

[57] ABSTRACT

A process is described for preparing a highly anisotropic aromatic pitch characterized by a high content of toluene insolubles, a low melting point, a low viscosity, and low content of quinoline insolubles by heat soaking a petroleum pitch derived from catalytic cracking residue at high temperatures for a short time followed by stripping the distillable oils. The pitch made in accordance with this process will yield a highly anisotropic carbon on carbonization at elevated temperatures.

14 Claims, No Drawings

PROCESS FOR PREPARING AN ANISOTROPIC AROMATIC PITCH

BACKGROUND OF THE INVENTION

Aromatic pitches such as coal tar pitch or petroleum pitch are composed of a complex mixture of alkyl substituted polycondensed aromatics of high molecular weight and a high degree of aromatic ring condensation. These heavy aromatic products may further be characterized as having a softening point of 100° to 130° C., and high viscosity of 1000–5000 cst at 160° C.

The important feature of pitch is that it can be transformed into a high strength carbon product on melting or carbonization. The microstructure of the carbon product produced is very much dependent on the type of pitch used, and may vary from a highly anisotropic structure having an ordered or crystalline structure, to an unordered or random isotropic structure. The anisotropic structure pitch is preferred for the production of carbon products such as carbon fiber or needle coke.

Many types of pitches can be produced by varying the aromatic feedstock materials and the processes used in pitch manufacture. One simple method to characterize these pitches is by the use of solvent analysis, for example, the degree of insolubility in benzene, toluene, pyridine, quinoline, or anthracene. For the purpose of the present invention, aromatic pitches are characterized by their insolubilities in toluene and quinoline.

Solvent analysis is a method which is universally used to define the type and composition of various pitches; the quantitative determination of insolubles in toluene and quinoline are two analytical protocols which have become standard in the industry. These insolubles represent the two major fractions of a pitch varying in aromaticity, degree of aromatic ring condensation, and coking characteristics. The different insoluble fractions of a pitch also differ in their physical characteristics such as melting, softening, and viscosity which is a critical requirement for carbon product manufacturing.

The solubility analysis for determining quinoline insolubles is conducted according to ASTM D2318-66 protocol; the solubility analysis for determining toluene insolubilities is conducted by mixing 40 grams of a sample in 320 ml of toluene over an 18-hour time period, filtering, washing the insolubles in additional toluene, drying, and calculating the yield of insolubles as a percentage of initial sample.

The most common feedstocks used for this production of pitches are the heavy aromatic residues obtained from coal carbonization, steam cracking, or the catalytic cracking processes of low molecular weight paraffinic hydrocarbons.

The production of a highly aromatic pitch which will yield a non-ordered, isotropic carbon has previously been described in U.S. Pat. No. 3,721,658. More particularly, this patent describes a process for preparing an aromatic pitch by the catalytic air oxidation of an aromatic feedstock such as steam-cracked tar, at a temperature of 240°–260° C. This pitch has low toluene insolubles (about 15%) and very low quinoline insolubles. Because of the chemical structure of the pitch, and not because of the toluene or quinoline insolubles content, this pitch on melting or carbonizing will yield a highly isotropic carbon.

Another example of aromatic pitch production may be found in U.S. Pat. No. 4,086,156. This patent describes a method for preparing an aromatic pitch by the thermal treatment of steam cracker tar in the absence of oxygen and at a temperature of 380°–390° C. The pitch obtained by this method contains a low concentration of toluene and quinoline insolubles and will produce an isotropic carbon on melting or carbonizing.

Unfortunately, the pitch produced from steam cracked tar is not very suitable for producing anistropic products. Only the pitches produced from catalytic cracking residue feedstocks have been found to be suitable. Examples of these suitable aromatic pitches are described in U.S. Pat. No. 4,219,404.

The residue obtained from the catalytic cracking processes of low molecular weight paraffinic hydrocarbons have been found to have the preferred physical and chemical characteristics for producing the pitch needed in the manufacture of anisotropic carbon products. More particularly, the typical physical and chemical characteristics of a suitable catalytic cracking residue feedstock material is presented in Table I.

TABLE 1

| Characteristics of Catalytic Cracking Residue | |
|---|---|
| Physical Characteristics | |
| Viscosity cst at 210° C. | 1.0–10.0 |
| Ash Content, wt. % | 0.010–2.0 |
| Coking Value (wt. % at 550° C.) | 6.0–10.0 |
| Asphaltene; (n-heptane insolubles), % | 0.1–12.0 |
| Toluene Insolubles, % | 0.010–1.0 |
| Number Average Mol. wt. | 220–290 |
| Elemental Analysis | |
| Carbon, % | 88.0–90.32 |
| Hydrogen, % | 7.74–7.40 |
| Oxygen, % | 0.10–0.30 |
| Sulfur, % | 1.0–4.5 |
| Carbon/Hydrogen Atomic Ratio | 0.90–1.0 |
| Chemical Analysis (by Carbon-13 Nuclear Magnetic Resonance Spectroscopy) | |
| Aromatic Carbon (atom %) | 55–75 |
| Aromatic Ring Distribution (by Mass Spectroscopy) | |
| 1 Ring (%) | 1.2 |
| 2 Rings (%) | 23.6 |
| 3 Rings (%) | 37.5 |
| 4 Rings (%) | 31.8 |
| 5 Rings (%) | 3.8 |
| 6 Rings (%) | 0.9 |
| Molecular Weight Distribution (by Mass Spectroscopy) | |
| 175–200 (%) | 2.9 |
| 220–225 (%) | 13.4 |
| 225–250 (%) | 29.5 |
| 250–275 (%) | 23.1 |
| 275–300 (%) | 15.5 |
| 300–325 (%) | 6.8 |
| 325–350 (%) | 3.5 |
| Composition (by Clay-Silica Gel Chromatography) | |
| Aromatic, % | 62.2 |
| Saturate, % | 17.0 |
| Polar, % | 18.3 |

Petroleum pitches, though complex in their chemical structure, can be characterized using advanced modern analytical techniques. For example, we can determine quantitatively the various protons (aromatic, benzylic, aliphatic and naphthenic) present in a pitch by using a proton Nuclear Magnetic Resonance Spectroscopy (P-NMR). We can also determine quantitatively the various types of carbon atoms present in the pitch (aromatic carbon, benzylic carbon and paraffinic carbon) by using a carbon-NMR. We can also determine their molecular weight distribution by using a high temperature gel permeation chromatography. Another important chemical characteristic is the carbon/hydrogen atomic ratio which can be calculated from the carbon and the hydrogen elemental analysis.

The process described in this patent deals with the production of a highly anisotropic aromatic pitch derived from catalytic cracking residue which has a high content of the desired fraction of toluene insolubles and a low level of quinoline insolubles, the toluene insoluble fraction having a low melting point and low viscosity. Our process also deals with the extraction of the toluene fraction from the pitch by solvent extraction.

This preferred fraction in the pitch corresponding to approximately the toluene insolubles have been found to produce highly anisotropic carbon products (e.g. needle coke and carbon fiber) at elevated temperatures. For example, the pitch can be used to produce a carbon fiber by spinning at elevated temperature and pressure. This toluene insolubles fraction of the pitch has very high optical activity (as seen by polarized light microscopy), low melting point and low viscosity and it is considered to be part of liquid crystal (or mesophase) in the pitch. The quinoline insoluble fraction in the pitch was found to have a very high melting point (350°–450° C.) and high viscosity hampering subsequent manufacturing of carbon products and thus is regarded as undesirable when present in the pitch in substantial quantities (e.g. over 5% by weight).

When a pitch is produced in a conventional manner from catalytic cracking residue which contains only the toluene insolubles fraction there is a major problem. When thermally treating the aromatic feed into a pitch, the toluene insolubes fraction start forming in the pitch initially, when the toluene insolubles level in the pitch reaches a certain level, the quinoline insolubles start forming in the pitch, presumably from the further condensation of the toluene insolubles.

We have discovered a process where a petroleum pitch with a high toluene insolubles content can be produced without excessive quinoline insoluble formation. This process takes advantage of the variation in the rate of formation of the toluene and quinoline insolubles which can be varied by varying the thermal treatment temperature and time.

SUMMARY OF THE INVENTION

Basically the process comprises initially thermally treating a petroleum pitch derived from catalytic cracking residue at a very high temperature (410° to 500° C.) for a short time period (less than about 120 minutes), effective to obtain a toluene insoluble level of at least 30% by weight while minimizing the quinoline insoluble level to less than 5% by weight, and then stripping the pitch to distill off all or part of the distillate oils in the pitch. The pitch is then preferably extracted with a suitable solvent to separate the toluene insoluble fraction.

DETAILED DESCRIPTION OF THE INVENTION

For this process, the feed is petroleum pitch derived from a catalytic cracking residue, preferably with a low level of toluene insolubles (i.e. 1–15%) and preferably derived from catalytic cracking of low molecular weight paraffinic hydrocarbons.

The selection of the process conditions, specifically heat soaking at a high temperature and short time, leading to the production of high mesophase pitches with high toluene insolubles fractions, i.e. at least 30%, preferably at least 40% by weight of the pitch, but not the undesired quinoline insolubles, i.e. less than 5%, preferably less than 3% by weight of the pitch, is critical. These conditions comprise a high temperature of 410° to 500° C., preferably 420° to 450° C., for a period of time less than 120 minutes, preferably 1 to 30 minutes, effective to obtain the toluene insoluble level of at least 30% by weight while minimizing the quinoline insoluble level to less than 5% by weight. An oxygen-free atmosphere such as nitrogen, hydrogen, or hydrocarbon is preferred to prevent undesirable reaction during heat soaking. Generally speaking, the higher the temperature is, the shorter is the time required. When the pitch is heat soaked for excessive time periods the quinoline insoluble level becomes excessive resulting in a pitch with an increased melting point and viscosity hampering subsequent manufacturing of carbon products.

After the high temperature, short time heat soak, the pitch is then stripped of the distillate (aromatic) oils in the pitch. These distillate oils provide the important function during the high temperature heat soak of acting as a diluent to prevent excessive coke and quinoline insoluble formation. A minor amount of the distillate oils could be removed prior to heat soaking, i.e. removal of distillate oils at a level of less than 5% by weight of the pitch, but preferably no distillate oils are removed prior to heat soaking.

The stripping of the distillate oils from the heat soaked pitch is an important step of our process. The stripping can be carried out by distillation in the presence of an inert gas (e.g. nitrogen or steam), but is preferably carried out by vacuum stripping in the temperature range of 250° to 400° C., for example by cooling the pitch to about 300° C. under nitrogen atmosphere and then heating gradually to 360°–370° C. under a reduced pressure of 0.1 to 65 mm Hg and vigorous agitation to avoid cracking. The removal of the aromatic oils from the pitch lead to increasing the carbon precursor (toluene insolubles) yield while lowering the melting point and the viscosity of the extracted precursor.

Many variations of the basic process can be made which will lead to the production of a pitch with a high toluene insolubles fraction and low quinoline insolubles. For example, the first stage of the process (the thermal treatment or heat soaking) can be carried out under reduced pressure (e.g. 100–700 mm Hg) although it is preferably carried out at atmospheric pressure.

The toluene insoluble fraction present in the high mesophase pitch prepared according to the process described in this invention has many of the physical and chemical characteristics desired for a precursor feed for the production of anisotropic carbon products such as carbon fiber or needle coke. The resultant toluene insoluble fraction should comprise:

Low melting point of less than 325° C., preferably less than 300° C., and low viscosity of less than 1000 cst at 360° C. The physical characteristics of low melting temperature and low viscosity are key to the manufacturing of carbon products at temperatures below 390°–400° C. where decomposition could take place;

Very high aromaticity and degree of aromatic ring condensation as indicated by the high aromaticity of the pitch (86% aromatic carbon atom) and the high carbon/hydrogen atomic ratio (1.70 to 1.80) are important to the desired anisotropic structure development;

Very high optical activity of at least 80%, preferably 100%, which is a measure of the desired anisotropic structure development; and Very good thermal stability as these fractions have been subjected to a high temperature during the initial thermal treatment and then subjected to reduced pressure to remove lower molecular weight hydrocarbons.

Thus not only does the process of this invention prepare a precursor (toluene insoluble fraction) at a high yield, but critically results in a precursor with characteristics which are important to the subsequent manufacturing of quality anisotropic carbon products.

The following method was used to prepare pitches described by the process of this invention. For pitch production a pilot unit consisting of an electrically heated metal reactor capable of operation under reduced pressure (e.g. 1–65 mm Hg) was used equipped with an agitator, nitrogen inlet, and a distillate recovery system to condense and collect the distillate during the thermal treatment and the vacuum stripping stages. The petroleum pitch derived from a catalytic cracking residue which was used in the examples was Ashland Pitch No. 240 which contained about 25 to 28% by weight distillate oil, 6 to 8% toluene insolubles, 0.1 to 0.5% quinoline insolubles; with the toluene insoluble fraction having an optical activity of about 75% and a melting point of about 325° C.

Seventy pounds of Ashland Pitch No. 240 was introduced into the metal reactor, equipped with agitator, inlet for nitrogen and electrically heated to around 150°–200° C. under an atmosphere of nitrogen. When the pitch was softened, agitation was started and the pitch was then heated to the desired high temperature (420°–450° C.) under nitrogen atmosphere. The mixture was then thermally treated for the desired time and cooled to around 300° C. The undesired distillate oils were then removed by heating the mixture gradually with agitation under reduced pressure (around 1–65 mm Hg). The pitch product was then cooled to around 200° C. and pumped out of the reactor under nitrogen atmosphere.

Examples 1 to 4 in Table II illustrate the usefulness of the vacuum stripping on the pitch composition to increase the level of toluene insolubles.

TABLE II

| Example | Feed | Heat Soak Conditions Temperature (°C.) | Heat Soak Conditions Time (Hrs.) | Pitch Composition Before Vacuum Stripping Toluene Insolubles (%) | Pitch Composition Before Vacuum Stripping Quinoline Insolubles (%) | Pitch Composition After Vacuum Stripping Toluene Insolubles (%) | Pitch Composition After Vacuum Stripping Quinoline Insolubles (%) |
|---|---|---|---|---|---|---|---|
| 1 | Ashland 240 | 410 | 1 | 21 | 1.5 | 32 | 1.0 |
| 2 | " | 410 | 2 | 22 | 1.8 | 35 | 2.3 |
| 3 | " | 420 | ½ | 20 | 1.4 | 43 | 1.0 |
| 4 | " | 420 | 1 | 22 | 1.8 | 46 | 2.0 |

Pitches have been produced according to the process described in this invention using a 10-gallon reactor using a 70-lb. feed (Ashland Pitch No. 240). Examples 5 to 10 in Table III illustrate the pitch production and provides the carbon precursor (toluene insolubles) and other key characteristics (melting point and viscosity). For comparison purposes, Examples 11 and 12 in Table III are given where no vacuum-stripping of pitch oil is made.

TABLE III

| Example | Feed | Heat Soak Conditions Temperature (°C.) | Heat Soak Conditions Time (Min.) | Vacuum Stripping (% Oil Removed) | Pitch Composition Toluene Insolubles (%) | Pitch Composition Quinoline Insolubles (%) | Precursor (Toluene Insolubles Characteristics) Melting Point °C. | Precursor (Toluene Insolubles Characteristics) Viscosity (Centistock at 360° C.) | Precursor (Toluene Insolubles Characteristics) Optical Activity (%) |
|---|---|---|---|---|---|---|---|---|---|
| 5 | Ashland 240 | 420 | 1 | 41.7 | 33 | 0.66 | 250–275 | 560 | — |
| 6 | " | 420 | 15 | 34.2 | 35 | 0.69 | 250–275 | — | 100 |
| 7 | " | 420 | 30 | 42.4 | 39 | 0.67 | 275–300 | 348 | 100 |
| 8 | " | 430 | 1 | 20.6 | 34 | 0.65 | 250–275 | — | 100 |
| 9 | " | 430 | 7 | 27.3 | 41 | 0.95 | 250–275 | 695 | 100 |
| 10 | " | 430 | 15 | 21.8 | 43 | 1.51 | 250–275 | — | 100 |
| 11 | " | 420 | 60 | 0 | 26 | 2.8 | 325–350 | 5687 | 100 |
| 12 | " | 400 | 120 | 0 | 22 | 1.4 | 325–350 | 9659 | 100 |

As will be readily appreciated, the pitch produced in accordance with the present invention will contain materials insoluble in quinoline at 75° C. This quinoline insoluble material may consist of coke, ash, catalyst fines, and high softening point materials generated during heat soaking. Consequently, after removing the oil from the heat soaked vacuum or steam stripped pitch, undesirable high softening point components present in the resultant mixture are preferably removed. A particularly preferred technique for removing these components is disclosed in copending application Ser. No. 29,760, filed Apr. 13, 1979, which application is incorporated herein by reference. Basically, the heat soaked and de-oiled pitch is fluxed, that is, it is treated with an organic liquid in the range, for example, of from about 0.5 parts by weight of organic liquid per weight of pitch to about 3 parts by weight of fluxing liquid per weight of pitch, thereby providing a fluid pitch having substantially all the quinoline insoluble materials (including inorganic matter) suspended in the fluid in the form of readily separable solids. The suspended solids are then separated by filtration or the like, and the fluid pitch is then treated with an antisolvent, i.e., an organic liquid or mixture of organic liquids capable of precipitating and flocculating at least a substantial portion of the pitch free of quinoline insoluble solids.

As will be appreciated, any antisolvent which will precipitate and flocculate the fluid pitch can be employed in the practice of the present invention. However, since it is particularly desirable in carbon fiber manufacture to use that fraction of the pitch which is readily convertible into an optically anisotropic phase and which has a low softening point and viscosity suitable for spinning, the antisolvent employed for precipitating the desired pitch fraction generally is selected from aromatic and alkyl substituted aromatic hydrocarbons and cyclic ethers and mixtures thereof. Examples of aromatic and alkyl substituted aromatic hydrocarbons include benzene, toluene, xylene, naphthalene, ethylbenzene, mesitylene, bi-phenyl and tetrahydronaphthalene. Representative examples of halogen substituted aromatic hydrocarbons include chlorobenzene, trichlorobenzene, bromobenzene, orthodichlorobenzene, and trichlorobiphenyl. Representative examples of cyclic ethers include furan and dioxane. Representative examples of mixtures of antisolvents include mixtures of compounds such as coal tar distillates, light aromatic gas oils and heavy aromatic gas oils.

The amount of solvent employed will be sufficient to provide a solvent insoluble fraction capable of being thermally converted to an optically anisotropic material. Generally, from about 1 part of pitch to 4 parts of solvent to about 1 part by volume of pitch to about 16 parts of volume of solvent, depending upon the type of solvent, will be employed. After precipitating and flocculating the pitch, the solvent insoluble fraction is separated by typical techniques such as sedimentation, centrifugation, filtration and the like.

Examples 13, 14, and 15 illustrate carbon precursor preparation by liquid-liquid extraction of the pitch with toluene. The pitch prepared in Example 9 was used as a feed for the extraction process. The pitch was crushed in small pieces with around ½" diameter and then mixed with toluene in 1:1 ratio in a first stage extraction. A small quantity of filter aid such as cilite was added. The mixture was then heated under nitrogen to reflux with mechanical agitation. The mixture was allowed to stand at reflux conditions for one hour and cooled to 95°–105° C. It was filtered while hot through a cilite pre-coated sparkler filter.

The filtrate was then diluted with toluene to bring the pitch:toluene ratio of 6:1 in a second stage extraction. The mixture was heated to reflux with agitation and allowed to cool slowly to room temperature (4–16 hours). The carbon insoluble was then filtered, washed with toluene and dried in a vacuum oven at 125°–160° C. for 24 hours.

In Examples 13, 14, and 15 as illustrated in Table IV, the preparation of carbon precursors by extraction is shown.

TABLE IV

| Example | First Extraction Stage (Pitch: Toluene Ratio) | Second Extraction Stage (Pitch: Toluene Ratio) | Yield (%) | Toluene Insoluble Characteristics: Melting Pt. (°C.) | Viscosity (Centistock at 360° C.) | Carbon/Hydrogen Atomic Ratio | Optical Activity (%) |
|---|---|---|---|---|---|---|---|
| 13 | 1:1 | 1:6 | 19.0 | 275–300 | 695 | 1.70 | 100 |
| 14 | 1:1 | 1:6 | 21.4 | 275–300 | 872 | 1.74 | 100 |
| 15 | 1:1 | 1:6 | 22.1 | 275–300 | 744 | — | 100 |

Examples 16, 17, and 18 illustrate the preparation of carbon fiber from insolubles precursor as prepared in Example 13. The carbon precursor powder was heated under nitrogen at around 350° C. to agglomerate the powder into a solid mass. The solid carbon precursor is then transformed into fibers with 8 to 10 microns diameter by heating to around 370° C. and spinning through a spinarate. The green carbon fibers are then oxidized at elevated temperature in the presence of air and carbonized in nitrogen atmosphere. Details of carbon fiber characteristics are listed in Table V.

TABLE V

| Example | Fiber Diameter (micron) | Tensile Strength (KSi) | Modulus (MSi) | Strain to Fail Ratio |
|---|---|---|---|---|
| 16 | 9.0 | 367 | 38.0 | 0.97 |
| 17 | 8.2 | 391 | 39.9 | 0.98 |
| 18 | 8.3 | 391 | 39.3 | 1.01 |

What is claimed is:

1. A process of preparing an aromatic pitch which produces a carbon product with an anisotropic structure comprising: heat-treating a pitch containing 1–15% toluene insolubles produced from a catalytic cracking residue, at 410° to 500° C. for a period of time less than about 120 minutes at atmospheric or reduced pressure effective to obtain a toluene insoluble level of at least 30% by weight of the pitch while minimizing the quinoline insolubles to less than 3% by weight of the pitch; and then stripping the distillable oil from the pitch.

2. Process of claim 1 wherein the treated aromatic pitch has a toluene insoluble fraction with a melting point of less than 325° C., a viscosity of less than 1000 cst at 360° C., and an optical activity of at least 80%.

3. Process of claim 2 wherein the heat treatment is carried out at 420° to 450° C. for 1 to 30 minutes.

4. Process of claim 3 wherein the treated aromatic pitch has a toluene insoluble content of at least 40% by weight.

5. Process of claim 4 wherein the treated aromatic pitch has a toluene insoluble fraction with a melting point of less than 300° C., and an optical activity of about 100%.

6. Process of claims 1 or 3 wherein the stripping is carried out by vacuum stripping at a reduced pressure of 0.1 to 65 mm Hg. and at a temperature within the range of 250° to 400° C.

7. Process of claims 1 or 3 wherein the heat-treatment of the petroleum pitch is made at atmospheric pressure under an oxygen-free atmosphere.

8. Process of claim 7 wherein the oxygen-free atmosphere contains gasses selected from the group consisting of nitrogen, hydrocarbon and hydrogen.

9. Process of claim 6 further comprising extracting the pitch with a solvent to separate the toluene insoluble fraction, then preparing an anisotropic carbon product from the fraction.

10. Process of claim 9 wherein the solvent is chosen from the group consisting of aromatic solvents, alkyl aromatics with one or more aromatic rings, and aromatics with a polar substituent.

11. Process of claim 9 wherein the solvent is an aromatic with a polar substituent and the polar substituent is chosen from the group consisting of nitrogen, oxygen or halogen.

12. Process of claims 1 or 3 wherein the petroleum pitch is produced from catalytic cracking of low molecular weight paraffinic hydrocarbons.

13. Process of claim 1 wherein the stripping is carried out by distillation in the presence of an inert gas.

14. Process of claim 13 wherein the inert gas is chosen from the group consisting of nitrogen or steam.

* * * * *